United States Patent [19]

Millard et al.

[11] 4,197,569

[45] Apr. 8, 1980

[54] INTERVALOMETER

[75] Inventors: Keith W. Millard, Festus; Marlin E. Crain, St. Louis, both of Mo.

[73] Assignee: Harvard Interiors Mfg. Co., St. Louis, Mo.

[21] Appl. No.: 872,933

[22] Filed: Jan. 27, 1978

[51] Int. Cl.[2] ..... F42C 9/00

[52] U.S. Cl. ..... 361/250; 89/1.814; 102/217

[58] Field of Search ..... 361/249, 250; 102/217; 89/1.814; 335/138

[56] References Cited

U.S. PATENT DOCUMENTS

| | | | |
|---|---|---|---|
| 3,396,628 | 8/1968 | Nash | 89/1.814 |
| 3,539,955 | 11/1970 | Nash | 335/138 |
| 3,617,813 | 11/1971 | Everest et al. | 361/250 |
| 3,700,971 | 10/1972 | Everest et al. | 361/250 |

*Primary Examiner*—B. A. Reynolds
*Assistant Examiner*—Clifford C. Shaw
*Attorney, Agent, or Firm*—Frailey & Ratner

[57] ABSTRACT

An intervalometer for use with airborne rocket launchers having a switch assembly with a multiplicity of switch positions relating to the rockets. A solenoid assembly moves the switch assembly sequentially through switch positions for distributing firing current to the rockets. An electronic timing circuit energizes the solenoid assembly for a fixed time duration independent of variations in and characteristics of the solenoid assembly. At the termination of that fixed timed duration (1) a firing current pulse is applied to an individual rocket and (2) an additional fixed time duration independent of the solenoid assembly is initiated by the timing circuit. At the termination of the additional time duration, the timing circuit again energizes the solenoid assembly and the sequence continues. In this way there is achieved a time between leading edges of sequential firing pulses which are consistent, accurate and independent of solenoid assembly characteristics.

10 Claims, 5 Drawing Figures

INTERVALOMETER

BACKGROUND OF THE INVENTION

A. Field of the Invention

This invention relates to a firing control device and more particularly to an intervalometer for use with airborne rocket launchers.

B. Prior Art

In airborne armament, an intervalometer is a firing control device which successively delivers pulses of current to each one in turn of a plurality of electrically detonated rockets carried on board a tactical combat aircraft such as that shown in U.S. Pat. No. 3,396,628. In response to closure of a fire button by the pilot, a movable electrical contact in the intervalometer is sequentially positioned adjacent to contacts coupled to the individual rockets. In prior intervalometers, the duration of the current pulse delivered to a fuse of each rocket is dependent upon the solenoid characteristics. In the ripple, or repetitive, firing mode, the interval between the firing of one rocket and the next is dependent on these characteristics as well.

Prior intervalometers such as that shown in U.S. Pat. No. 3,539,955 maintain electrical grounding on each rocket fuse terminal until the moment the rocket is fired and whose continued operation is not interrupted by the presence of a short-circuited firing fuse. A movable electrical contact is rotated by a solenoid actuated pawl bearing upon a ratchet wheel. Auxiliary contacts operated by the solenoid motion first interrupt the current to the solenoid and secondly forwardly firing current to the movable contact. Since the duration of the solenoid current pulse is thereby controlled by the speed with which the solenoid responds, the amount of current built up in the coil is a variable and this in turn affects the speed with which the solenoid returns to the starting position to begin another advance of the contact. Since the current to the rocket fuse is available only during the time that the solenoid is pulled away from its rest position, the duration of the firing pulse is also heavily dependent upon the solenoid characteristics.

Accordingly, the duration of the current pulse to prior solenoids must remain within specified limits despite variations in manufacturing procedures and a wide range of temperature and humidity conditions to which the intervalometer is exposed during flight. Moreover, even the viscosity of the lubricant used in the solenoid and switch has an important effect and this can vary with age as well as temperature. If this duration is too brief, the duration of the pulse of firing current to the rocket may not be long enough to ensure reliable ignition of the propellant. If, on the other hand, the duration of the solenoid current pulse is excessive, the length of the interval between successive rocket launchings in the ripple mode may become too large and thereby cause too few of the rockets in the barrage to land on a small target area. The prior art left much to be desired in intervalometers which on one hand could be inexpensively produced but on the other hand would possess more consistent timing characteristics.

Accordingly, an object of the present invention is an intervalometer wherein the duration of the solenoid current pulse is fixed and independent of solenoid characteristics. Another object of the present invention is an intervalometer wherein the interval between successive rocket firings in the ripple mode is similarly fixed. Another object of the present invention is the elimination of moving contacts in the circuits which control solenoid current. Another object of the present invention is generation of firing pulses whose duration is not affected by solenoid operation.

SUMMARY OF THE INVENTION

An intervalometer for use with launchers for airborne rockets having a switch assembly with a plurality of switch positions each related to an individual rocket. An electromagnetic assembly is operable for moving the switch assembly sequentially through selected switch positions. An electronic timing circuit energizes the electromagnetic assembly for a first fixed timed duration independent of variations in and characteristics of the electromagnetic assembly. Accordingly, the switch assembly is actuated from one to another switch position. After the first time duration a firing pulse is distributed to a rocket for ignition thereof and a second fixed time duration is initiated also independent of the electromagnetic assembly. At the end of the second time duration, the electronic timing circuit again energizes the electromagnetic assembly and the ripple sequence continues. In this way the times between leading edges of firing pulses are fixed, accurate and independent of electromagnetic assembly characteristics.

DETAILED DESCRIPTION

Figure 1:
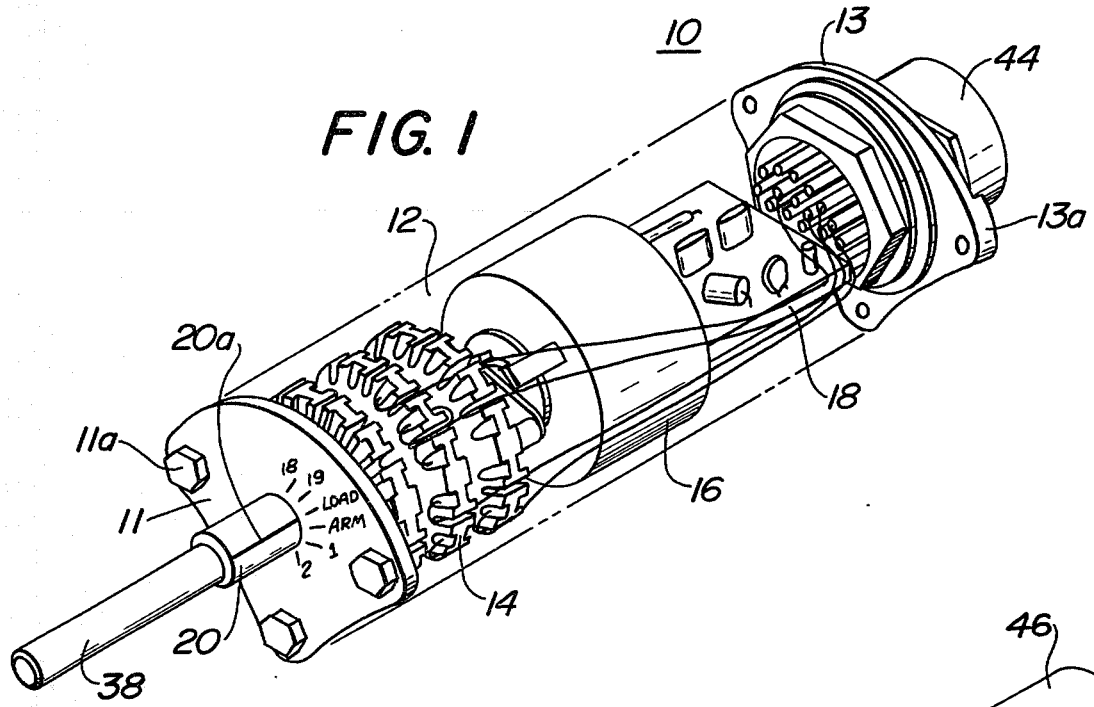
FIG. 1 is a perspective view of the intervalometer of the present invention in which the interior components are shown in phantom view.
Figure 2:
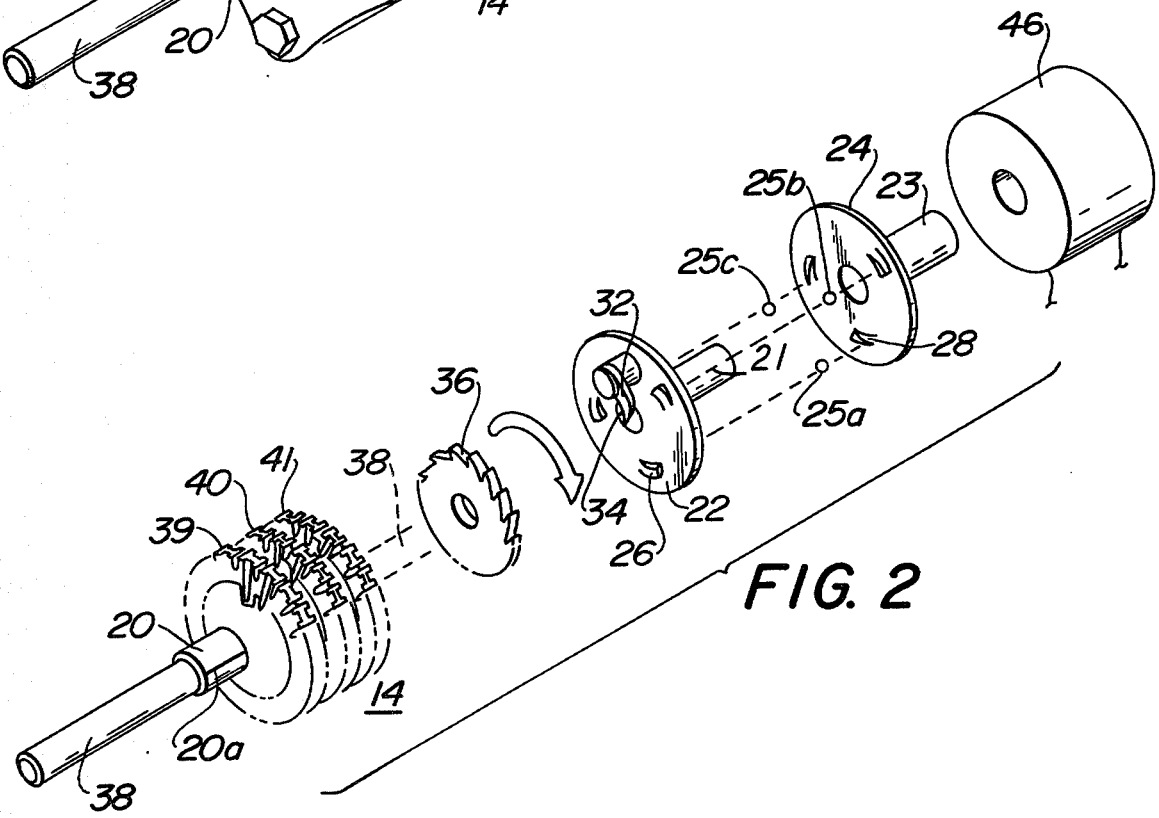
FIG. 2 is a perspective exploded view of the solenoid and switch assemblies of FIG. 1.

Referring to FIGS. 1 and 2, the intervalometer or firing control device 10 is housed in a case 12 which may be, for example, approximately 5 inches long having an interior cylindrical cavity approximately 1½ inches in diameter. Within the case are a rotary switch assembly 14, a rotary electromagnetic solenoid assembly 16 and an electronic circuit 18. The shaft of solenoid assembly 16 is mechanically coupled to the shaft of switch assembly 14. Switch assembly 14 is mounted to the front end plate 11 with an extension of its shaft 38 protruding through. A knob 20 with an indicator **20*a* is fastened to shaft 38. End plate 11 is fastened to case 12 with a plurality of fastening devices 11*a***.

A connector 44 is mounted on rear end plate 13 for establishing electrical connections between the elements within the intervalometer 10 and associated apparatus external to it as later described. End plate 13 is fastened to case 12 with a plurality of fastening devices **13*a***. Intervalometers are described in the prior art such as in U.S. Pat. No. 3,539,955.

As will later be described, electronic circuit 18 comprises an oscillator and digital frequency divider which function together to deliver timing pulses of fixed duration at fixed intervals to energize solenoid assembly 16 which advances the movable contact of switch assembly 14. This ensures that the solenoid assembly will always be adequately energized and that the duration and repetition interval of firing pulses are unaffected by solenoid characteristics. Also part of this circuit is an electronic switch which is activated by the collapse of the solenoid's magnetic field and accordingly delivers pulses of uniform duration to each rocket in turn.

Shaft 23 of solenoid assembly 16 rotates through a fraction of a full revolution every time solenoid coil or solenoid 46 receives an impulse of current from circuit 18. Each time the solenoid shaft rotates, shaft 38 of switch 14 is moved to a new angular position. A multiplicity of angular positions comprise one full revolution. Shaft 38 of the switch protrudes through an opening in the end plate 11. Knob 20 is affixed to the shaft of switch assembly 14 and thereby permits the switch to be manually set to any desired angular position. Knob 20 has an indicator **20*a*** which serves to indicate which position the switch is in. In this embodiment, the switch can be set to one of at least 21 different angular positions referred to as "load," "arm" and "1" through "19."

Both solenoid assembly 16 and switch assembly 14 are well known in the art and may comprise a single assembly of the type made by Oak Switching Division of Oak Industries, Inc., part no. 5-53142-116.

When current flows through the windings of solenoid coil 46, plunger 21 is drawn into bushing 23 forcing bearing plate 22 against face plate 24. The plates, however, have tangential ramped grooves 26 and 28 in which balls **25*a-b-c* are situated so that the axial force on plunger 21 forces bearing plate 22 to rotate through an angle, as for example 20°. When the current in coil 46 is interrupted, a coil spring (not shown) returns bearing plate 22 to its initial angular position. When solenoid assembly 16 is so actuated, a pawl 34 at the end of pawl lever 32 fixed to the plunger is forced against one tooth of rachet wheel 36. This causes shaft 38** to advance through an angular increment.

When solenoid 16 returns to its initial position, pawl 34 rides up the ramped surface of the next tooth and falls into place against its steep edge in readiness for the next advance. The rotors of decks 39, 40 and 41 of switch assembly 14 are coupled to shaft 38. The rotors of these decks carry circular contacts with tables extended radially or notches which selectively engage or interrupt connection with a multiplicity of contacts spaced angularly on the surrounding stators. Although only 21 discrete angular positions of the switch are required, switch 14 has 24 index positions spaced 15°. Switch shaft knob 20 with integral indicator **20*a* is fixed to the end of shaft 38**.

Figure 3:
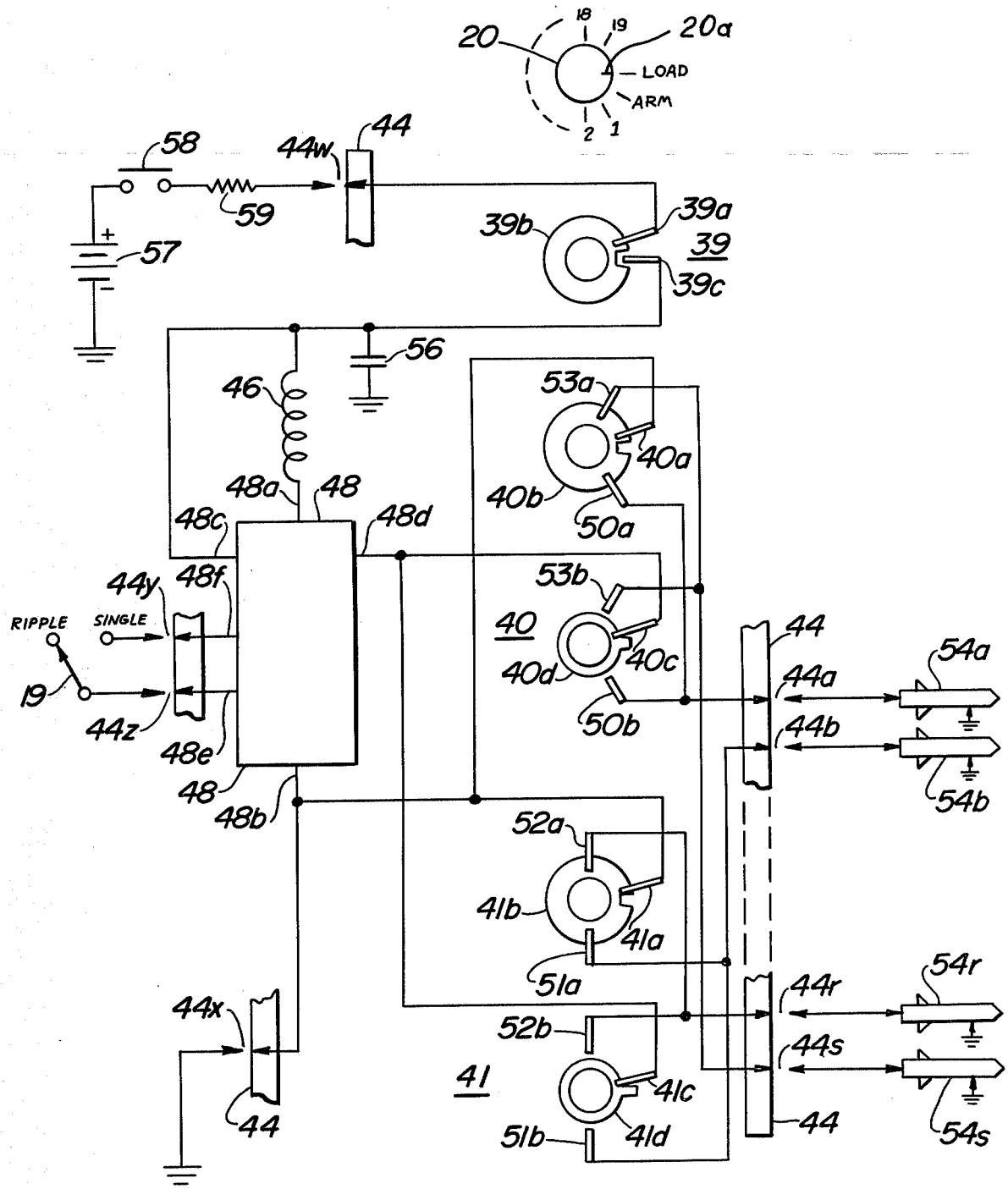
FIG. 3 is a schematic circuit diagram of the intervalometer and associated apparatus of FIG. 1.

FIG. 3 shows intervalometer 10 connected to a plurality of rockets **54*a* through 54*s* of rocket launcher 60, pilot's firing button 58 and mode switch 19. Connections to the intervalometer are made by way of contacts 44*a*–44*s* of connector 44. The rockets 54*a–s* are installed in launcher tubes. On each one, one terminal of the electrically fired detonator is extended to a particular terminal of intervalometer connector 44** while the other terminal is the rocket case which is in contact with the launching tube and thus in contact with the grounded aircraft frame.

The negative side of the aircraft's 24 volt DC power supply 57 is grounded. The positive side of the supply is brought to the pilot's firing button 58 which is a normally open push switch. When this switch is held closed, aircraft power is extended by way of a current limiting resistor 59 and connector terminal **44*w* to contact 39*a* of switch deck 39. Resistor 59** is typically 5 ohms and thereby limits fault current to about 5 amperes to avoid damage to the aircraft electrical system in case a short-circuit within the intervalometer should develop.

Prior to loading the rockets in the launcher, switch pointer 20 is turned to the "load" position. The switch rotors are shown in this position in FIG. 3. With the switch in this position, the notch of rotor contact **39*b* surrounds stator contact 39*c* and no current can flow from the aircraft power supply to any part of the intervalometer circuit should firing button 58 be accidentally closed. Rotor contacts 40*b* and 41*b* of switch decks 40 and 41 are continuously held at ground potential by way of stator contacts 40*a* and 41*a*. This in turns holds contacts 50*a*, 51*a*, 52*a* and 53*a*** at ground potential. These contacts are extended to various rocket fuses as shown to prevent the build up of voltage on these terminals by induction or other stray coupling which could lead to the premature firing of a rocket during the loading process.

The rotor of switch deck 40 is double-sided, having contact **40*b* on one side and 40*d* on the other. Stator contact 40*a* is in continuous contact with 40*b*. Stator contact 50*a* is coupled to rocket 54*a* and 53*a* is coupled to rocket 54*s*. Other contacts on this stator, while not shown for purposes of simplicity, are located at positions around the stator spaced two index intervals apart and are connected to every other rocket 54*c* through 54*q* (not shown). Rotor contact 40*b* has a notch so that contact 50*a* is ungrounded only when the switch is in position 1. Contact 53*a* is ungrounded only when the switch is in position 19. On the other side of the rotor, contact 40*d* is in continuous contact with 40*c*. Other stator contacts 50*b* and 53*b* are connected to their counterpart contacts 50*a* and 53*a* as shown. Other contacts on this side of the stator not shown are similarly connected. Contact 40*c* conveys firing current when available from electronic circuit board 48. This current can flow to rocket 54*a* by way of contact 50*b* only when the switch is in position 1 and to rocket 54*s* only when the switch is in position 19**.

Switch deck 41 is constructed in a manner identical to that of switch 40 except that the various stator contacts are placed in angular positions intervening those at which stator contacts are located on switch deck 40. Thus, the notice of rotor contact **41*b* and the tab of contact 41*d* are positioned adjacent to stator contacts 51*a* and 51*b* which lead to rocket 54*b* only when the switch is in position 2. Similarly, the notch and tab are adjacent to contacts 52*a* and 52*b* which lead to rocket 54*r* only when the switch is in position 18. Other contacts not shown are located at intervals spaced at two angular increments and lead to rockets 54*d*, 54*f* through 54*p***.

When the aircraft is ready to take off and the rockets have all been loaded, switch pointer **20*a* is manually positioned to "arm." This now establishes continuity from the firing button circuit to solenoid 46 and electronic circuit board 48. All contacts leading to rockets, however, are still grounded by rotor contacts 40*b* and 41*b* and the tabs of contacts 40*b* and 41*b* are in contact with none of the rocket contacts thereby continuing the protection against accidental firing by stray voltages. A ripple/single mode switch 19 is not disposed on intervalometer 10 but is installed nearby on the rocket launcher assembly. Switch 19 is connected to terminals 48*f* and 48*e* by way of connector terminals 44*y,z***.

Prior to take off, the mode switch 19 is set by the ground crew for example, to either the ripple or the single position depending on the mission requirements. When the switch is in the single mode, only one rocket will be fired each time the pilot closes his firing button and repeated operations of this button are necessary to fire successive rockets. When switch 19 is in the ripple mode, the rockets will automatically fire in sequence at a rapid rate when the button is closed such that all 19 rockets will be discharged within one second.

When a firing sequence is initiated, a current path from terminals 48*a* to 48*b* is established within the electronic circuit board 48 for a specific time interval so that solenoid 46 is energized by current flowing from the aircraft power supply 57 through the pilot's firing button 58, resistor 59 and returning to the aircraft frame by way of connector terminal 44*x*. This causes the angular position of the switch to be advanced from the "arm" position to position 1. Shortly after this advance is completed as will later be explained, the current in solenoid 46 is interrupted and a current path is established from terminals 48*c* to 48*d* of circuit 18 to contacts 40*c* and 41*c* of switch. In position 1, the tab of 40*d* is in contact with 50*b*. Accordingly, ground is removed from contact 50*a* by virtue of the notch of 40*b* being at that position and current flows to the fuse of rocket 54*a* thereby firing it. On a subsequent cycle, a solenoid 46 is again energized advancing switch 41 from position 1 to position 2 following which the solenoid current is interrupted and a current path once again is established by way of 48*c* and 48*d* to switch contact 51*b* firing rocket 44*b*. This sequence is repeated until all nineteen rockets have been fired after which the switch will continue to step through one or more additional angular increments until it has returned to the "load" position. At that point, continuity is broken between contacts 39*a* and 39*c* and further operation of the intervalometer is prevented. The design of the electronic circuit is such that the successive advance of switch 14 is not impeded by the presence of short-circuited or open-circuited rocket fuses. Filter capacitor 56 stores some of the energy necessary to actuate solenoid 46 and electronic circuit 48 so that functioning during a switch cycle is not affected by the bouncing of contacts within switch 58 and noise picked up on the electrical line leading from this switch to the intervalometer.

Figure 4:
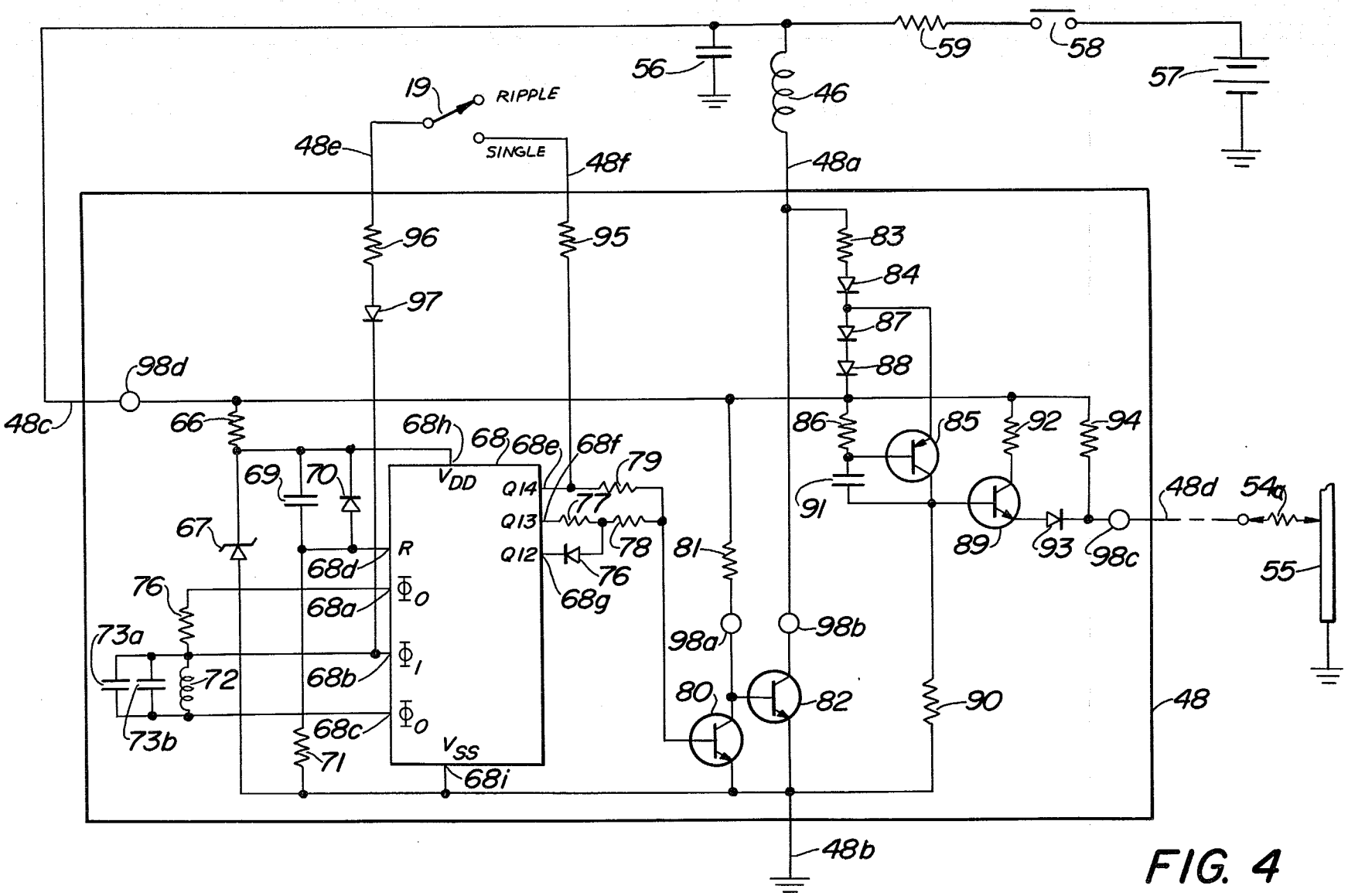
FIG. 4 is a detailed schematic diagram of a portion of FIG. 3.

The ability of intervalometer 10 to deliver pulses long enough to ensure reliable rocket launching without unduly lengthening the interval between successive rocket firings despite manufacturing tolerances and wide variations in environmental conditions depends on the availability of solenoid current pulses having uniform duration and uniform spacing. Such means are embodied within the electronic circuit 48 which is shown in FIG. 4. The principal functions within circuit 48 comprise an oscillator, a counter/divider, a solenoid current switch and a firing current switch.

The oscillator and counter/divider functions are combined in an integrated circuit 68 which may be, for example, of the type made by RCA Corporation part no. CD4060A. In oscillator/divider 68, the portion devoted to the oscillator function comprises transistor gates which provide current amplification and pulse shaping. In order for the oscillator to provide a signal whose frequency and amplitude are stable over a wide range of power supply voltage and temperature, external resonant circuit components must be connected in a manner later to be described.

The counter/divider portion of circuit 68 comprises fourteen binary flip-flops cascaded with the outputs of all but the first three brought out to external terminals. The oscillator output is connected internally to the input of the first flip-flop and it can be seen that $2^{14}$ or 16,384 oscillator cycles must occur to cycle the chain of flip-flops through every possible combination of states. The oscillator frequency is thus divided by successive powers of 2 at the various flip-flop outputs. A feedback resistor 76 and a tuned circuit consisting of inductor 72 and capacitors 73*a–b* are connected as shown to terminals 68*a–c*. Capacitor 73*b* is small compared to capacitor 73*a* and is selected during manufacture to set the operating frequency to 409.6 KHz.

In operation, it will be assumed that switch 19 is in the illustrated ripple position. Upon closure of firing button 58, the aircraft power supply voltage is applied to terminal 48*c* and current flows through resistor 66 and Zener diode 67 establising a voltage of 5.6 volts across the latter to supply a stable operating voltage at lead 68*h* for oscillator/divider 68. When this voltage initially appears, capacitor 69 is completely discharged and a similar voltage is applied to terminal 68*d* which resets the 14 cascaded flip-flops within oscillator/divider 68 to their 0 states. Capacitor 69, connected between terminals 68*h* and 68*d* and to resistor 71 and is charged by current flowing through resistor 71 and thus terminal 68*d* reaches ground potential in a short amount of time. When this voltage falls below the low threshold, the flip-flops are free to operate and are toggled by the tuned circuit oscillator. The output of the most significant flip-flop appears at terminal 68*e*; the output of the next most significant flip-flop appears at terminal 68*f*, the next at terminal 68*g* and so forth. Representing the flip-flop states by a 14 bit binary number, the states will advance from 00 0000 0000 0000 (the start of count when the fire button 58 is first closed) to 11 1111 1111 1111 in $2^{14}$ oscillator cycles, or 40 milliseconds, if the oscillator action is unimpeded and will then repeat the cycle every 40 milliseconds as long as power is available and no other constraints have been introduced.

Terminal 68*f* will first go high (state 1) 10 milliseconds after the count was all zeroes. However, terminal 68*g* is low at this point. Without the presence of diode 76, a 1 at terminal 68*f* would supply sufficient current by way of resistors 77 and 78 to the base of transistor 80 to turn the latter on. However, the 0 at terminal 68*g* clamps the junction of resistors 77 and 78 to ground potential and thereby diverts this current. As the count continues, terminal 68*g* becomes high 5 milliseconds later and transistor 80 is thereby driven into conduction 15 milliseconds after the start of count. When terminal 68*g* becomes high, it can deliver sufficient current by way of resistor 79 to the base of transistor 80 to turn it on regardless of the availability of current through resistors 77 and 78. Terminal 68*e* does not become high until 20 milliseconds after the start of count and remains high until the count returns to 0. The collector of transistor 80 is connected to the base of transistor 82. When transistor 80 is on, current from aircraft power supply 57 through resistor 81 is diverted from the base of transistor 82 turning that transistor off. Since transistor 80 is off for the first 15 milliseconds, transistor 82 thereby is in the conducting state for the first 15 milliseconds following the start of the cycle and is turned off for the remainder. Current thus flows through solenoid 46 for a predetermined time duration of 15 milliseconds and is then interrupted. When the current through transistor 82 ceases, the energy stored in the collapsing magnetic field of the solenoid causes the voltage at terminal 48*a* to become more positive than 48*c*; a phenomenon called "inductive kickback." This causes a current flow from the bottom end of the solenoid through resistor 83, diode 84 to the emitter and base of transistor 85, returning through resistor 86. With its base emitter junction forward-biased, transistor 85 conducts, raising the voltage at the base of transistor 89 which is normally held low by resistor 90.

Capacitor 91 connected between the collector and base of transistor 85 damps out the response to voltage transients that may be present on the power line which might otherwise cause premature or erratic firing. Diodes 87 and 88 provide an additional path for the current flow caused by the reverse solenoid voltage to prevent overloading the base emitter junction of transistor 85. The inductance of solenoid 46 and the total resistance around this circuit path are such that transistor 85 is maintained in conduction for 10–20 milliseconds given any combination of manufacturing tolerance and temperature.

Transistor 89 is connected as an emitter follower and, when its base voltage is raised, current is caused to flow from the aircraft power supply at terminal 48*c* by way of resistor 92 and diode 93 through the rocket fuse which is connected by the previously described rotary switch to terminal 48*d*. Resistor 94 provides a small current to terminal 98*c* when transistor 89 is off to facilitate test and diagnosis while diode 93 prevents the emitter of transistor 89 from being excessively reverse biased during such operations.

In the previous operation, switch 19 has been assumed to be in the ripple position. Accordingly, the switch contacts are open and the 14-stage counter will go through a complete cycle of states every 40 milliseconds as described above, permitting successive disharging of rockets at the rate of 25 per second (though only 19 rockets are in the launcher). When in the single position, the switch contacts are closed and a path from terminal 68*e* to 68*b* of oscillator 68 is established by way of resistors 95 and 96 and diode 97. Thus when terminal 68*e* becomes high 20 milliseconds following the start of cycle, the oscillator terminal is biased such that no further cycles of the oscillator can occur. Resistor 95 prevents inductor 72 and resistor 76 from interfering with this biasing operation. With the oscillator stopped, the counter remains in the state 10 0000 0000 0000 for as long a time as the firing button is held closed. Upon entering this state, the current to the solenoid is interrupted and a pulse of firing current is delivered to the rocket that is pointed to after which operation is suspended. When the pilot releases the firing button, voltage is removed from terminal 48*c* and capacitor 69 will discharge by way of resistor 66, resistor 81 and transistor 80. When the pilot once again closes the firing switch, a new application of voltage at terminal 48*c* causes the counter chain to be reset as explained previously. With terminal 68*e* at state 0, the oscillator can function normally and generate a current pulse on the solenoid lasting 15 milliseconds and thereby cause the firing of the next rocket in line.

From the foregoing, it will be understood that the current pulse supplied to solenoid 48 prior to each rocket firing whether in the single or ripple mode always has a duration of exactly 15 milliseconds. This period is a function only of the oscillator frequency and the fixed frequency division ratio established by the flip-flop and connections of terminals 68*e,f,g*, by way of resistors 77, 78, 79 and diode 76 to the base of transistor 80. With the amount of energy stored in the solenoid's magnetic field thus closely controlled the amount of energy during the collapse of the magnetic field is also controlled and the duration of the time that transistor 85 conducts is substantially constant. This ensures that transistor 89 will consistently deliver pulses of firing current that exceed the minimum allowance and yet will not cause variation of the 40 millisecond period between successive rocket firings since the latter interval is also a function only of the oscillator frequency and the flip-flop configuration in the counter/divider.

Further, resistor 92 in series with the collector of firing pulse output transistor 89 prevents the voltage at terminal 48*c* from becoming less than about 5 volts even in the event of a short circuit rocket fuse so that the operation of the clock oscillator is not disabled by such an occurrence. Since drive current to the base of this transistor is removed whenever current is supplied to the solenoid, the switch will simple step to the next rocket and continue with the firing cycles so that all rockets may be discharged, save any with defective fuses.

Figure 5:
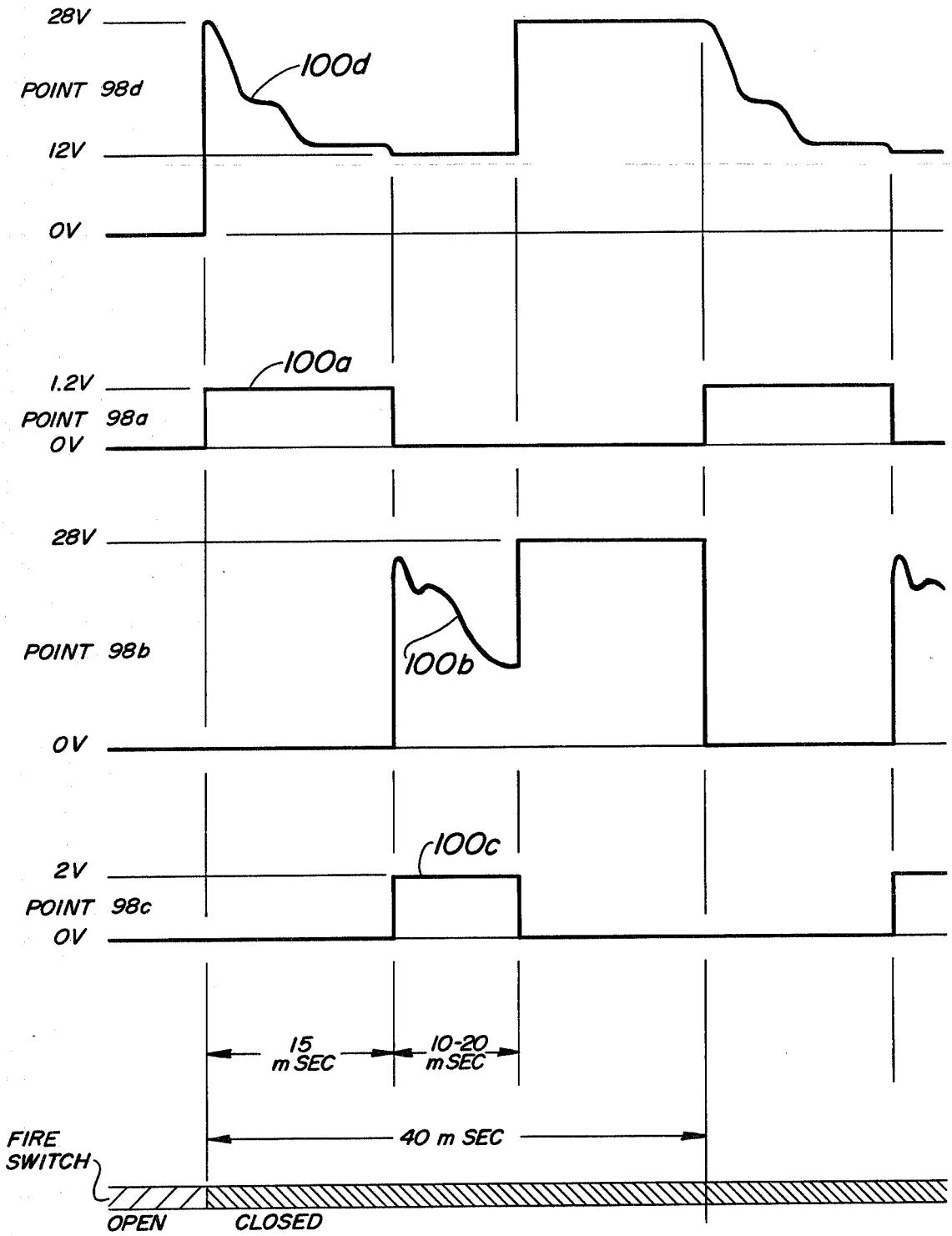
FIG. 5 is a set of voltage waveforms occuring at key junctions within the intervalometer of FIG. 1 during operation.

Typical voltage waveforms observed at junctions 98*a–d* during a firing cycle are shown in FIG. 5. The voltage at junction 98*a* is shown by waveform 100*a*. Prior to closing the firing switch 19 there is no power available to the intervalometer and all voltages therein are at zero. When power becomes available, the counter divider is reset and no base current is delivered to transistor 80 for a fixed period (first time duration) of 15 milliseconds as described previously. Transistor 80 is therefore cutoff from this period and current delivered through resistor 81 forward biases the base emitter junction of transistor 82. The junction point 98*a* between the collector of transistor 80 and the base of transistor 82 is therefore about 1 volt positive during this period. At the termination of the 15 millisecond duration, base current is supplied to transistor 80 causing it to conduct into saturation clamped junction 98*a* essentially to 0 volt where it remains until a new intervalometer cycle is initiated.

The voltage at the junction point 98*b* between the collector of transistor 82 and the solenoid 46 is represented by waveform 100*b*. With base current supplied to transistor 82 as described above, this transistor conducts into saturation for the first 15 milliseconds and the voltage is clamped essentially to 0 volts. When the collector current of transistor 82 is interrupted (at the beginning of the second time duration), the inductive kickback causes the voltage at 98*b* to suddenly become more positive than the other end of the solenoid which is connected to junction 98*d*. This causes current to flow through the path established by resistor 83, diode 84, the base emitter junction of transistor 85 and resistor 86 as explained previously. As the magnetic field decays or collapses, the current which flows becomes less intense. This decrease is also affected by the change of inductance of the solenoid as the plunger returns to its relaxed position thus producing a descent as shown. When this current flow ceases, output transistor 89 interrupts the supply of current to the rocket fuse at which time there is no longer any current drain from the power supply 57 and 98*b* rises to the power supply potential until the end of the second time duration which is the termination of the 40 millisecond period.

The voltage at junction point 98c between resistor 94 and diode 93 is the voltage developed across the rocket fuse when output current is delivered to it and is approximately 2 volts during the time that transistor 85 and consequently transistor 89 are on as explained previously. This voltage is at 0 at all other times.

Junction point 98d associated with terminal 48c which is connected to the power supply by way of resistor 59 whenever the firing switch 58 is closed. At the instant the firing switch is closed, the full potential of the power supply appears at this junction whose voltage is represented by waveform 100d. As current starts to build up in solenoid 46, the voltage drop across resistor 59 accordingly increases and voltage at 98d accordingly decreases. The change of solenoid inductance as the plunger is pulled inward and contributes a modulation of this voltage decay. When solenoid current is interrupted by transistor 82, it immediately starts flowing through the alternate path previously described and causes current supplied to the intervalometer to flow through the rocket fuse thereby maintaining a more or less constant voltage drop across resistor 59 to produce about 12 volts at 98d. When current to the rocket fuse ceases, there is no voltage drop across resistor 59 and the voltage at 98d assumes the full potential of the power supply.

It will now be understood that the firing period and the solenoid duty cycle are established by an L-C controlled clock oscillator and digital countdown circuits. This is preferred because the required components are physically small and few in number and the frequency stability of the oscillator is less than 0.5%.

Another embodiment of this intervalometer is one that is utilized in 10-round launchers. Construction would be the same except that switch assembly 14 would comprise one less deck and have 12 instead of 24 index positions and the oscillator frequency would be lowered to provide fixed firing intervals of 62, rather than 40 milliseconds.

In another embodiment, current is caused to flow through the base emitter junction of transistor 85 by connection through additional resistors and diodes to output terminals 68e,f,g rather than the decaying solenoid current following the turn off of transistor 82. Thus, for example, transistor 89 would be made to conduct when terminal 68e entered state 1 except that it would cease to conduct when both terminals 68f and 68g were also in state 1. Transistor 89 would deliver firing current for exactly 20 milliseconds immediately following the end of the 15 millisecond solenoid current pulse. This would prevent variations in the inductive time constant of the solenoid from producing even the smallest variations in firing pulse duration.

What is claimed is:

1. An intervalometer for use with launchers for airborne rockets comprising switch means having a plurality of switch positions each relating to an individual rocket, means coupled to said switching means for providing rocket firing current, electromagnetic means operable for moving said switch means sequentially through selected switch positions for distributing firing current in turn to said rockets for ignition thereof, and electronic timing means for energizing said electromagnetic means for a first predetermined time duration independent of variations in characteristics of said electromagnetic means thereby to actuate said switch means from one to the other of the selected switch positions in sequence said electronic timing means including a major flow path for flow of current to provide said energization of said electromagnetic means thereby to develop magnetic energy therein, control means coupled to said electromagnetic means and to said means providing firing current, said control means responsive to the termination of said first time duration for providing a path auxiliary to the major flow path for flow of current resulting from the decay of said magnetic energy to control the timing of the firing current to an individual rocket.

2. The intervalometer of claim 1 in which said electronic timing means provides a timing signal having a second predetermined time duration starting at said first time duration termination and having a magnitude of time to ensure sufficient firing current time for ignition and said second time duration being independent of variations and characteristics of said electromagnetic means.

3. The intervalometer of claim 2 in which said first and second time durations are fixed and nonvariable.

4. The intervalometer of claim 3 in which there is provided ripple means for actuating said electronic timing means to successively start a new first time duration at the termination of each second time duration thereby to successively energize said electromagnetic means to actuate said switch means to the next sequential position.

5. The intervalometer of claim 4 in which said electromagnetic means includes a solenoid coil which stores a predetermined amount of magnetic energy during each first time duration and provides a current maintained for a predetermined time duration during decay thereof during each second time duration.

6. The intervalometer of claim 5 in which said electronic timing means includes an oscillator controlled by a resonant circuit for providing said first time duration independent of the variations and characteristics of said solenoid coil.

7. The intervalometer of claim 6 in which there is provided single switch means for turning off said oscillator during said second time duration after firing current is initiated whereby only a single rocket is ignited.

8. The intervalometer of claim 7 in which said electronic timing means includes a divider circuit actuated by said oscillator for producing each said first and second time durations.

9. The intervalometer of claim 8 in which said means for providing firing current includes a resistor for protecting said oscillator from a short circuited rocket fuse.

10. The intervalometer of claim 5 in which said control means includes at least one switching device coupled to said coil which is turned on to provide said auxiliary current path upon decay of said magnetic energy.

* * * * *